US006102757A

United States Patent [19]

Ishigaki

[11] Patent Number: 6,102,757

[45] Date of Patent: Aug. 15, 2000

[54] WATER JET PROPULSION DEVICE FOR MARINE VESSEL

[75] Inventor: Eiichi Ishigaki, Kagawa-ken, Japan

[73] Assignee: Ishigaki Company Limited, Tokyo, Japan

[21] Appl. No.: 09/117,999

[22] PCT Filed: Dec. 8, 1997

[86] PCT No.: PCT/JP97/04482

§ 371 Date: Aug. 11, 1998

§ 102(e) Date: Aug. 11, 1998

[87] PCT Pub. No.: WO98/25815

PCT Pub. Date: Jun. 18, 1998

[30] Foreign Application Priority Data

Dec. 11, 1996 [JP] Japan ..... 8-331004

[51] Int. Cl.[7] ..... B63H 11/00; B63H 11/103

[52] U.S. Cl. ..... 440/47; 440/38

[58] Field of Search ..... 440/38, 46, 47, 440/48; 60/221, 271

[56] References Cited

U.S. PATENT DOCUMENTS

| | | | |
|---|---|---|---|
| 3,040,696 | 6/1962 | Dahle | 440/46 |
| 3,082,732 | 3/1963 | Stallman | 115/16 |
| 3,253,567 | 5/1966 | Patton | 440/46 |
| 3,613,630 | 10/1971 | Jacuzzi | 115/12 |
| 3,943,876 | 3/1976 | Kiekhaefer | 115/12 R |
| 5,509,832 | 4/1996 | Roos | 440/47 |
| 5,658,176 | 8/1997 | Jordan | 440/46 |

FOREIGN PATENT DOCUMENTS

| | | |
|---|---|---|
| 1262291 | 10/1989 | Japan . |
| 345396 | 4/1991 | Japan . |
| 4221293 | 11/1992 | Japan . |
| 5105189 | 4/1993 | Japan . |
| 6286692 | 4/1993 | Japan . |

*Primary Examiner*—S. Joseph Morano
*Assistant Examiner*—Patrick Craig Muldoon
*Attorney, Agent, or Firm*—Howard & Howard

[57] ABSTRACT

A pump frame (7) is secured to a bottom (1*b*) of a ship in such a manner that a lower opening (19) is opened into water adjacent to a stern (1*a*) of the ship. A mixed flow pump (8) is secured to a frame (12) provided for the bottom (1*b*). A suction opening (26) of the mixed flow pump (8) is connected to a connection opening (17) in the upper portion of the pump frame (7). A discharge pipe (13) is connected to a discharge opening (27)) of the mixed flow pump (8). An impeller shaft (33) is horizontally extended in a pump casing (9) of the mixed flow pump (8). The impeller shaft (33) is provided with an impeller (11) for sucking and pressurizing water below the bottom (1*b*) through an introduction opening (19). Water pressurized by the impeller (11) is jetted to the rear of the stern through the discharge pipe (13) so that a ship (1) is propelled. The foregoing water jet propulsion apparatus (5) enables sucking performance free from cavitation and excellent propelling performance to be obtained.

18 Claims, 7 Drawing Sheets

WATER JET PROPULSION DEVICE FOR MARINE VESSEL

TECHNICAL FIELD

The present invention relates to a water jet propulsion apparatus adaptable to a ship and incorporating a mixed flow pump, and more particularly to a propulsion apparatus having improved suction performance and navigating performance.

BACKGROUND ART

Hitherto, a water jet propulsion apparatus has been known as disclosed in, for example, Japanese Patent Laid-Open No. 5-270486, with which water is sucked from a suction opening opened in a bottom of a ship, sucked water is pressurized by a horizontal impeller of a pump disposed above a surface of water and water is jet to a position in the rear of a stern of the ship so that the ship is propelled. Another water jet propulsion apparatus has been disclosed in, for example, Japanese Patent Publication No. 7-117076, which incorporates a volute casing disposed horizontally and with which an impeller is rotated to spirally swirl water sucked from a position below the bottom of the ship so as to jet a swirl water flow to a rear portion to the ship.

The water jet propulsion apparatus disclosed in Japanese Patent Laid-Open No. 5-270486, however, has the structure that the impeller of the pump is disposed above the surface of water. Therefore, when the ship starts navigating, the internal portion of a pump casing must be negative pressure to lift water below the surface of water to the position of the impeller. Thus, there is apprehension about difficulty in starting easily.

Since the impeller is disposed apart from the bottom of the ship, a passage in a suction portion of the impeller is too long, a long actual lift to the impeller is required and great resistance is generated in the suction portion. As a result, cavitation takes place when the ship is navigated at high speed.

Since the propulsion apparatus is secured to the ship at the suction and discharge portions to cause the suction portion to be supported at the bottom of the ship and the discharge portion to be supported at the stern, a process for making coincide a main shaft of the impeller and the axis of a drive shaft of a motor with each other cannot easily be performed. A deviation between the two shafts must be absorbed by dint of a play realized by securing a projection portion and the stern to each other such that the somewhat play is provided. If the two axes are connected to each other with an eccentricity, the main shaft disposed horizontally is deflected by dint of the weight of the impeller and vibrations of the motor are transmitted to the main shaft. Therefore, the rotating impeller is brought to the bottom of the pump casing, thus causing the impeller to be worn. Thus, there is apprehension that an adverse influence is exerted on the efficiency of the pump.

The water jet propulsion apparatus disclosed in Japanese Patent Publication No. 7-117076 has the structure that the volute pump casing is disposed horizontally. Therefore, if the ship is separated from the surface of water because of waves and thus air is sucked together with water, air cannot easily be discharged. Thus, eddy currents of air are generated, causing cavitation to take place. As a result, there is apprehension that the propelling performance deteriorates.

The present invention has been achieved to solve the above-mentioned problems, an object of the present invention is to provide a water jet propulsion apparatus which is capable of reducing resistance which arises when water is introduced and cavitation occurring when a ship is navigated at high speed and which can easily be mounted.

DISCLOSURE OF THE INVENTION

According to the present invention, there is provided a water jet propulsion apparatus for a ship comprising: a pump frame having an upper opening, a lower opening and a water passage for establishing a communication between the upper and lower openings, the pump frame joined to a bottom of a ship in such a manner that the lower opening is opened into water adjacent to a stern of the ship; a mixed flow pump having a suction opening, a discharge opening and an impeller, the suction opening arranged to be continued from the upper opening, the impeller sucking water below the bottom of the ship through the lower opening so as to pressurize water; and a discharge pipe connected to the discharge opening of the mixed flow pump and arranged to jet out water pressurized by the impeller toward a rear of the stern of the ship.

Since the structure is arranged as described above, water introduced from the water passage into the mixed flow pump is accelerated while water is pressurized by the blades of the impeller. Then, water is moved in the discharge pipe so as to be jetted to the rear portion of the stern so that the ship is forwards navigated.

Since the water jet propulsion apparatus incorporates the mixed flow pump, air introduced into the pump casing from the bottom of the ship can easily be discharged even if air is introduced because the ship floats by dint of waves. Therefore, deterioration in the propelling performance occurring because of generation of cavitation can be prevented.

Moreover, lower ends of blades of the impeller may be disposed below a surface of water.

The above-mentioned structure enables the lower ends of the impeller to be disposed below the surface of water. Thus, the negative pressure in the introduction portion of the pump casing and water pressure below the surface of water are able to realize a state in which water reaches the impeller because water can easily be introduced through the lower opening of the pump frame. Therefore, the operation of the apparatus can easily be started.

Moreover, a width of the lower opening of the pump frame may be enlarged toward a stem of the ship.

The above-mentioned structure enables water flows below the bottom of the ship to widely be picked up during navigation of the ship. Since air sucked into the mixed flow pump through the lower opening can easily be discharged, deterioration in the propelling performance caused from generation of cavitation can furthermore reliably be prevented.

Moreover, an end of the lower opening of the pump frame adjacent to a stem of the ship may be placed more adjacent to the stem as compared with a position directly below an end of the upper opening adjacent to the stem, and a front portion of the water passage of the pump frame adjacent to the stem may be upwards inclined toward the stern of the ship.

The above-mentioned structure enables water below the bottom of the ship to smoothly be introduced into the mixed flow pump during navigation of the ship without any opposition to the flow of water.

A rear portion of the pump frame adjacent to the stern of the ship may downwards project over the bottom of the ship and the lower opening of the pump frame is inclined in such a manner that an angle made from the bottom of the ship is not less than 20 degrees nor more than 30 degrees.

The above-mentioned structure has the arrangement that the rear portion of the pump frame which is adjacent to the stern of the ship and which downwards projects over the bottom of the ship receives water flows below the bottom of the ship and introduces the water flows into the water passage. Therefore, water flows can efficiently be introduced into the water passage.

A pump support member for supporting the mixed flow pump from a lower position may be provided for the bottom of the ship.

The above-mentioned structure has an arrangement that the propulsion apparatus is secured to the ship by joining the mixed flow pump to the pump support member provided for the bottom of the ship. Moreover, the suction opening is connected to the upper opening of the pump frame. That is, the propulsion apparatus is secured to the ship at only one position in the suction portion thereof. Therefore, the process for locating the main shaft of the impeller to a predetermined position with respect to the drive shaft of the motor can easily be performed. As a result, deviation of the axis of the main shaft can reliably be prevented. Even if vibrations of the motor are transmitted to the main shaft, the rotating impeller cannot easily be brought into contact with the inner surface of the mixed flow pump. Therefore, deterioration in the efficiency of the pump which takes place owning to abrasion of the impeller can be prevented.

Elastic cushioning members may be provided for a connecting portion between the suction opening of the mixed flow pump and the pump frame and the other connection portion between the discharge opening of the mixed flow pump and the discharge pipe respectively.

The above-mentioned structure incorporates the cushioning member having elasticity and provided for each of the connection portion between the suction opening of the mixed flow pump and the pump frame and the connection portion between the discharge opening of the mixed flow pump and the discharge pipe. Therefore, when the mixed flow pump is horizontally disposed, the mixed flow pump may first be located such that the main shaft of the impeller is positioned at a predetermined position with respect to the drive shaft of the motor. The reason for this lies in that a deviation of the position of the mixed flow pump with respect to the pump frame and the discharge pipe can be absorbed by the cushioning members. Therefore, a locating process for locating the main shaft of the impeller at a predetermined position with respect to the drive shaft of the motor can furthermore easily be performed. Thus, generation of a deviation of the axis of the main shaft can reliably be prevented.

The cushioning members are able to absorb vibrations of the mixed flow pump and the vibrations transmitted to the ship through the pump frame and the discharge pipe can be reduced.

A structure may be employed in which the mixed flow pump incorporates a pump casing, a suction casing and a main shaft, the pump casing has the discharge opening and accommodates the impeller, the suction casing has the suction opening and is arranged to establish a communication between the pump casing and the pump frame, and the main shaft is provided with the impeller, formed substantially horizontally in the pump casing and arranged to be rotated, blades of the impeller are spirally joined to the main shaft, outer ends of the blades are disposed adjacent to an inner surface of the pump casing and the outer leading ends of the blades adjacent to the introduction portion downwards extend toward the suction casing, and long and twisted guide blades disposed more close to the discharge portion than the blades are arranged around the main shaft.

In the above-mentioned structure, water introduced into the pump casing through the water passage in the pump frame is accelerated while water is pressurized by the sequential and spiral blades of the impeller. Then, water is guided along the twisted guide blades in the axial direction of the shaft of the impeller so that water is rectified. The impeller generates strong sucking force in the screw blades in the front portion thereof by dint of the propelling force thereof. Since the blades of the impeller are continuously formed, centrifugal force is generated in the rear portion of the impeller. Therefore, energy added to water in the front portion of the impeller can be converted into energy of pressure. Therefore, sucking performance and propelling performance can be improved.

A plurality of the mixed flow pumps may be connected in series in a horizontal direction.

The above-mentioned structure is able to raise jetting speed and thus great propelling force can be obtained. As a result, the ship can be navigated at high speed.

An opening/closing valve may be provided for a passage formed between the lower opening of the pump frame and the impeller.

The above-mentioned structure enables the mixed flow pump to be decomposed or removed in a state in which the ship floats on water when the opening/closing valve is closed without a necessity of lifting the ship above the surface of water. Therefore, even if breakdown or the like takes place during navigation, repair and inspection, such as maintenance and change of parts, can easily be performed.

BEST MODE FOR CARRYING OUT THE INVENTION

A first embodiment of the present invention will now be described with reference to the drawings.

Figure 1:
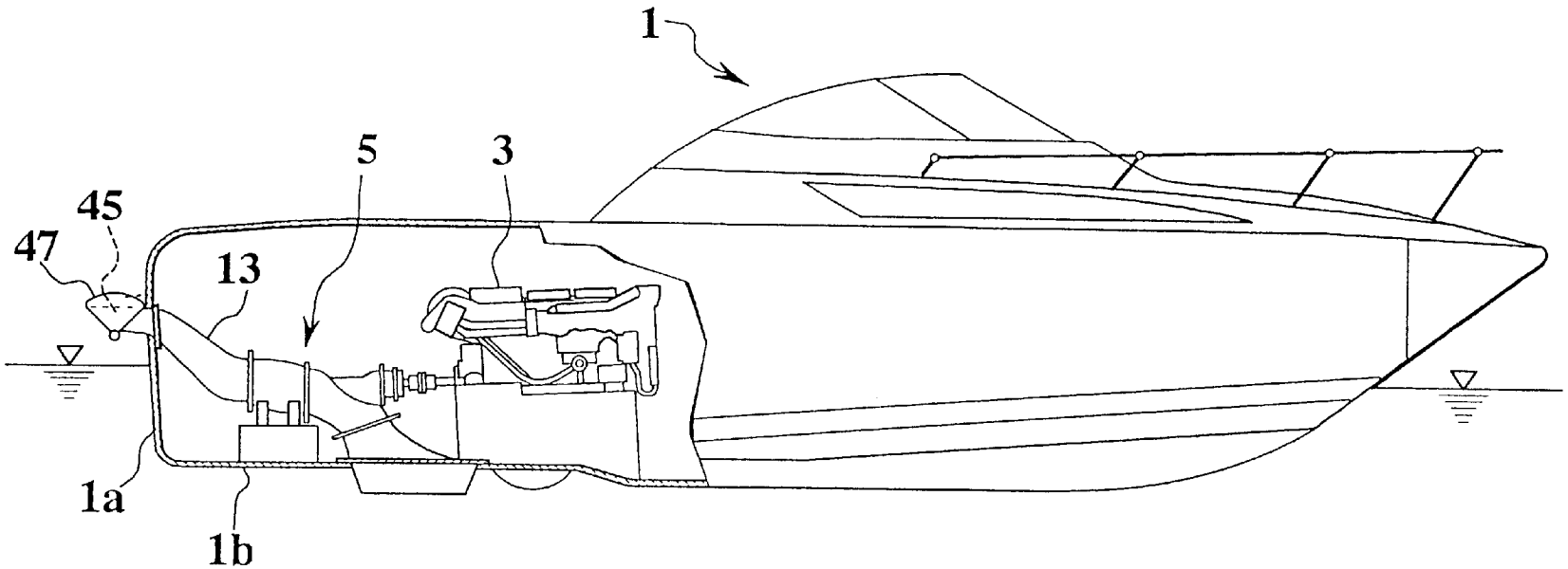
FIG. 1 is a vertical side view schematically showing a ship having a water jet propulsion apparatus according to a first embodiment of the present invention.

As shown in FIG. 1, a water jet propulsion apparatus 5 is connected to an engine (a motor) 3 disposed adjacent to a stern 1*a* of a ship 1. The propulsion apparatus 5 sucks water below a bottom 1*b* of the ship 1 and jets pressurized and accelerated jet water to a rear portion of the stern 1*a*. Thus, the ship 1 is propelled by dint of reaction of jetted water.

Figure 2:
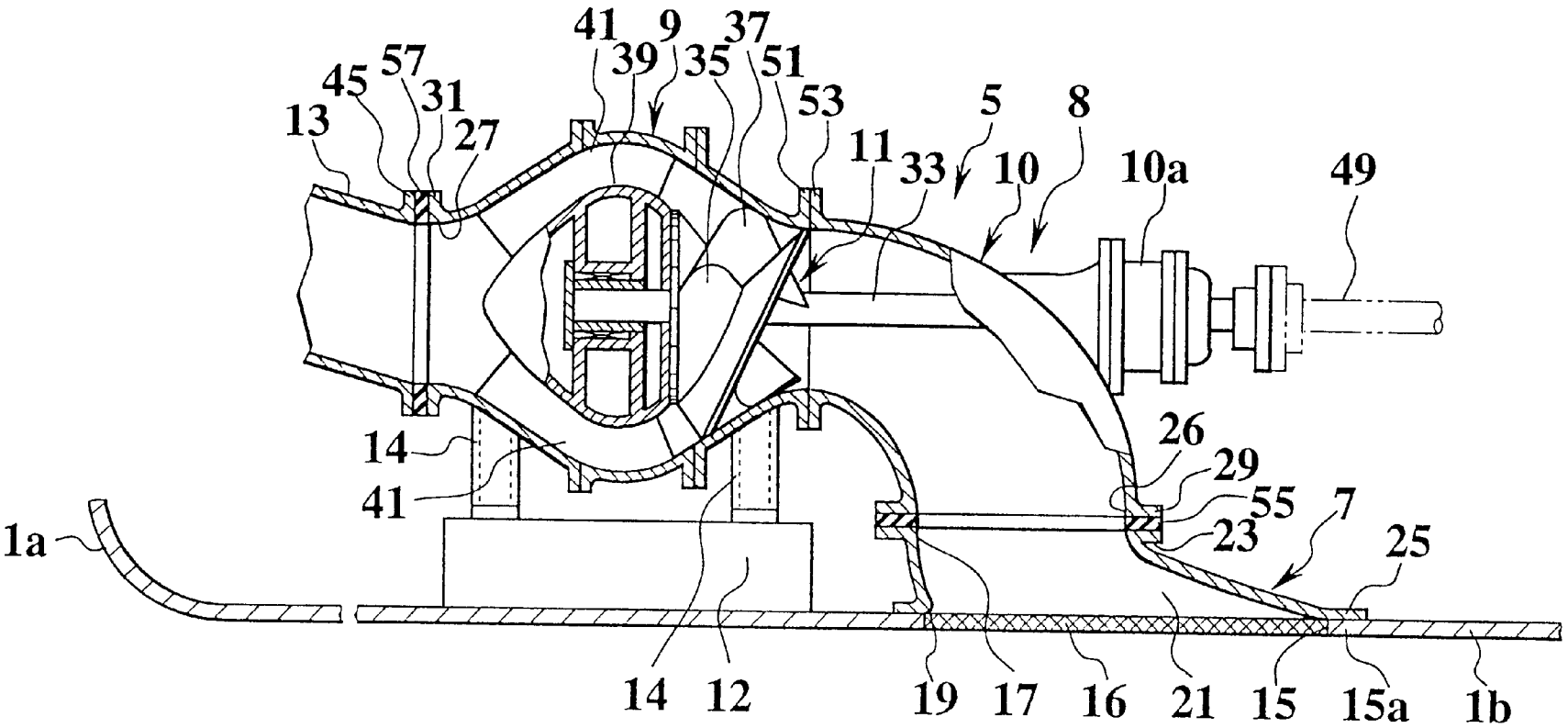
FIG. 2 is a vertical cross sectional view showing a side portion of the water jet propulsion apparatus shown in FIG. 1.

As shown in FIG. 2, the propulsion apparatus 5 incorporates a pump frame 7, a mixed flow pump 8 and a discharge pipe 13.

Figure 3:
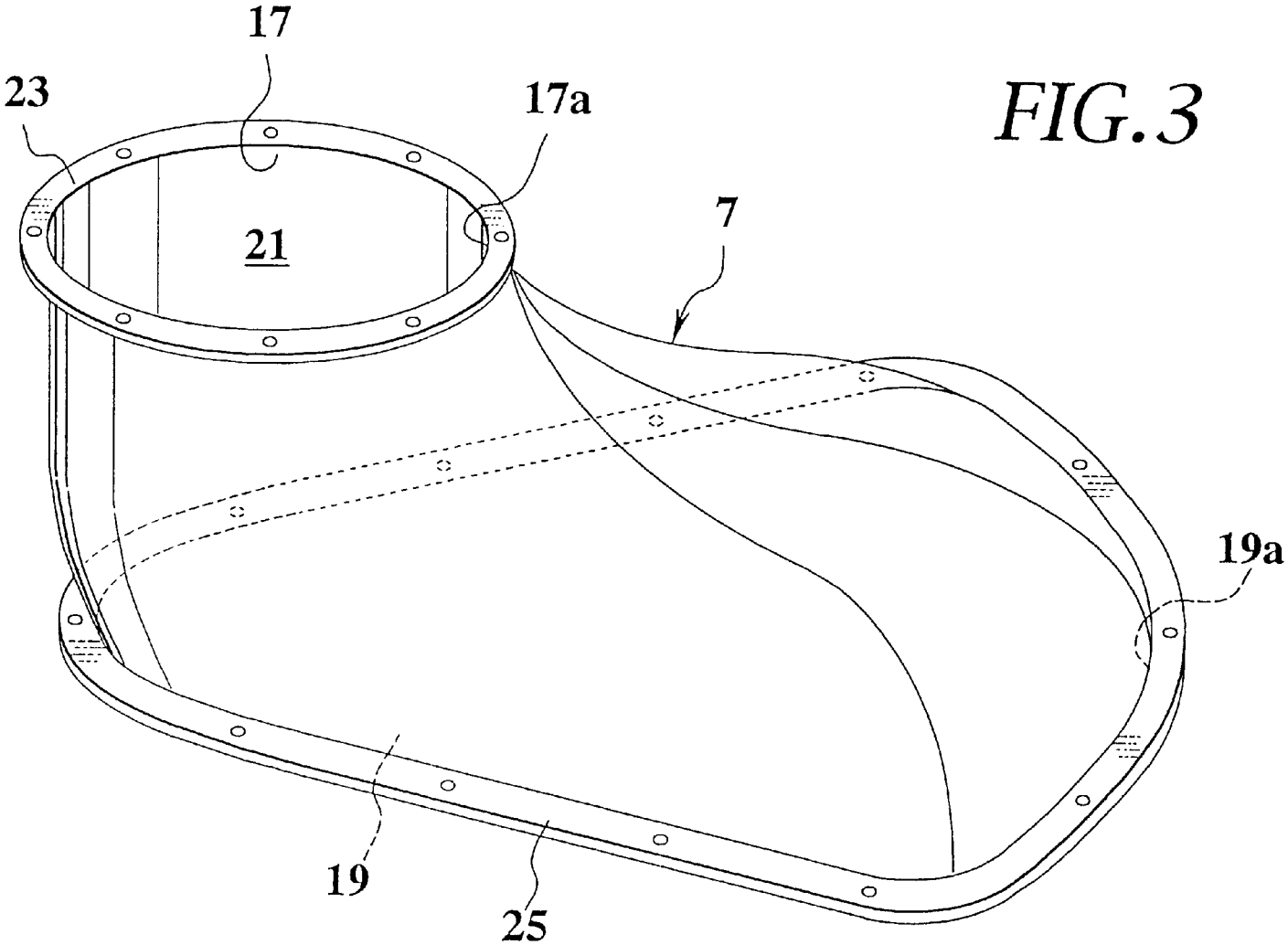
FIG. 3 is a perspective view showing the pump frame shown in FIG. 1.

An opening 15 is formed in the bottom 1*b* at a position adjacent to the stern 1*a*. The pump frame 7 is secured to a periphery 15*a* of the opening 15. As shown in FIG. 3, the pump frame 7 is formed into a cylindrical shape having an upper connection opening (an upper opening) 17, a lower introduction opening (a lower opening) 19 and a water passage 21 for connecting the connection opening 17 and the introduction opening 19 to each other.

Connecting flanges 23 and 25 are formed in the peripheries of the connection opening 17 and the introduction opening 19, respectively. The introduction opening 19 is formed into a sector-like shape widened in a direction in which the ship is navigated forwards so that the width of the introduction opening 19 is enlarged in the direction (toward a stem) in which the ship is navigated forwards. A front end 19*a* of the introduction opening 19 adjacent to the stem is disposed more close to the stem as compared with a position directly below a front end 17*a* of the connection opening 17 adjacent to the stem. As a result, the introduction opening 19 has a shape extending in the direction in which the ship is navigated forwards as compared with the connection opening 17. The pump frame 7 has a low shape, while the water passage 21 has a short length. Thus, the lower end of an impeller 11 (see FIG. 2) of the mixed flow pump 8 is disposed below the surface of water. The front portion of the water passage 21 adjacent to the stem is upwards inclined toward the stern 1*a* to corresponds to deviation between the front ends 17*a* and 19*a* adjacent to the stem. The pump frame 7 having the above-mentioned structure is, as shown in FIG. 2, secured to the bottom 1*b* by securing a flange 25 in the periphery of the introduction opening 19 to a periphery 15*a* of the opening 15 with bolts. The introduction opening 19 is opened in water at a position adjacent to the stern 1*a*. Note that a screen 16 for preventing introduction of foreign mater covers the opening 15 of the bottom 1*b*. Although this embodiment has the structure that the introduction opening 19 has the sector-like shape, another shape, for example, a circular shape, an elliptic shape or a rectangular shape, may be employed.

The mixed flow pump 8 incorporates a pump casing 9 and a suction casing 10 connected to each other in such a manner that communication is permitted. Moreover, the mixed flow pump 8 incorporates the impeller 11 accommodated in the pump casing 9. The mixed flow pump 8 is disposed substantially horizontally. The pump casing 9 has a discharge opening 27. The suction casing 10 has a suction opening 26. The pump casing 9 and the suction casing 10 are connected to each other by connecting corresponding flanges 51 and 53 to each other with bolts.

A frame 12 serving as a pump support member for supporting the mixed flow pump 8 from a lower position is provided for the bottom 1*b* at a position closer to the stern 1*a* as compared with the opening 15. Support legs 14 downwards projecting from front and rear portions are formed in the outer periphery of the pump casing 9. The mixed flow pump 8 is secured to the ship 1 by placing the support legs 14 on the upper surface of the frame 12 and by securing the frame 12 and the support legs 14 with bolts. A height of the mixed flow pump 8 supported by the frame 12 and the support legs 14 is made such that the lower end of the impeller 11 is lower than the surface of water. In this embodiment, the impeller 11 is perfectly submerged in water.

The suction casing 10 is formed into an L-shape pipe. Connecting flanges 29 and 31 are provided for the outer peripheries of the suction opening 26 of the suction casing 10 and the discharge opening 27 of the pump casing 9. The suction casing 10 and the pump frame 7 are connected to each other by connecting the flange 29 in the outer periphery of the suction opening 26 to the flange 23 in the outer periphery of the connection opening 17 with bolts. The pump frame 7 has a low shape to correspond to the height of the supported mixed flow pump 8. Also the suction casing 10 has a low shape. Thus, the distance from the introduction opening 19 of the pump frame 7 to the leading end of the impeller 11 is shortened so that suction resistance is reduced.

The pump casing 9 includes a impeller shaft (a main shaft) 33. The impeller shaft 33 is connected to a drive shaft 49 of an engine 3 (see FIG. 1) on the outsides of the pump casing 9 and the suction casing 10 adjacent to the stem. The impeller shaft 33 is substantially horizontally inserted into the pump casing 9 toward the stern 1*a* through a bearing portion 10*a* provided for the suction casing 10. A leading end of the impeller shaft 33 in an inserting direction is rotatively supported by a bearing case 39. A front portion of the impeller shaft 33 in the bearing case 39 is provided with the impeller 11 which sucks water below the bottom 1*b* so as to pressurize water.

Figure 4:
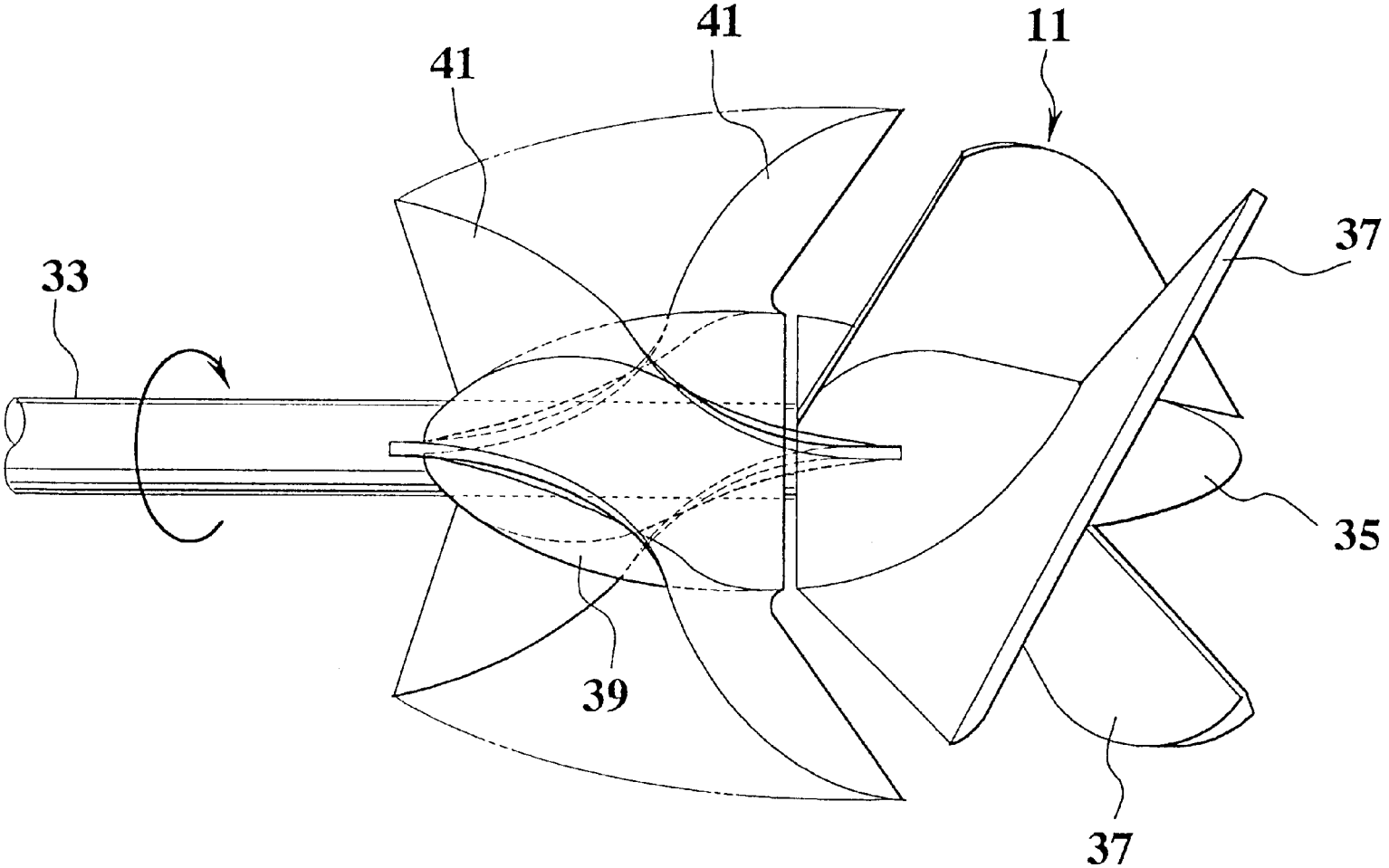
FIG. 4 is a side view showing the shape of the impeller and guide blades shown in FIG. 1.

As shown in FIG. 4, the impeller 11 incorporates a hub 35 secured to a lower end of the impeller shaft 33 and three spiral and projecting blades 37 provided for the hub 35. As shown in FIG. 2, the outer peripheries of the blades 37 are disposed adjacent to the inner surface of the pump casing 9 in order to improve a volumetric efficiency and a balance efficiency of the pump. A leading end of the blades 37 adjacent to the suction opening 26 (adjacent to the stem) extends to a position adjacent to the suction casing 10. As a result, the suction performance of the pump can be improved. Simultaneously, the suction portion of the impeller 11 is not clogged with suspended matter introduced into the pump frame 7. Note that the number of blades of the impeller 11 can arbitrarily be changed to be adaptable to the size of the ship 1.

The inner surface of the pump casing 9 has a parabolic shape. Dish-shaped water passages are formed by sectioning the portion between the inner surface of the pump casing 9 and the bearing case 39. Thus, water introduced through the suction portion 26 is pressurized and formed into spiral swirl flows by the surfaces of the blades of the impeller 11.

A portion of the water passage in the rear of the impeller 11 (a water passage around the impeller shaft 33 from the blades 37 to the discharge opening 27) is provided with four long and twisted guide blades 41. The guide blades 41 project over the bearing case 39. A portion adjacent to the leading ends of the guide blades 41 forms a water passage for parabolically guiding swirl flows pressurized by the impeller 11, while a portion adjacent to the trailing ends of the guide blades 41 forms a water passage for converting the guided swirl flows into straight flows. Also the number of the guide blades 41 may arbitrarily be changed similarly to the number of the blades 37.

As shown in FIGS. 1 and 2, the discharge pipe 13 has an end connected to the pump casing 9 and another end projecting over the stern 1*a*. The two ends are connected to each other through a curved portion. A flange 43 is formed at the end of the discharge pipe 13. When the flange 43 is connected to the flange 31 of the discharge opening 27 of the pump casing 9 with bolts, the pump casing 9 and the discharge pipe 13 are connected to each other in such a manner that communication is permitted. The other end of the discharge pipe 13 is supported by the stern 1*a* from a lower position. A jet nozzle 45 is provided for the other end of the discharge pipe 13. Jet water pressurized and accelerated by the impeller 11 is squeezed by the jet nozzle 45 so as to be jetted to the rear of the stern 1*a*. Thus, the ship 1 is navigated forwards. The jet nozzle 45 is provided with a reverser 47 for reversely navigating the ship 1. The reverser 47 switches a direction in which jet water is jetted from the jet nozzle 45 from a direction toward the rear of the stern to a direction toward a front portion of the stern. When jet water is jetted to the front portion of the stern, the ship 1 is navigated rearwards.

A flexible joint 55 serving as a cushioning member is disposed between the flange 29 of the suction opening 26 of the mixed flow pump 8 and the flange 23 of the connection opening 17 of the pump frame 7. Similarly, a flexible joint 57 serving as a cushioning member is disposed between the flange 31 of the discharge opening 27 of the mixed flow pump 8 and the flange 43 of the discharge pipe 13. The flexible joints 55 and 57 are made of stainless steel and rubber so that each of the flexible joints 55 and 57 has flexibility.

The operation of this embodiment will now be described.

In the above-mentioned propulsion apparatus 5, water below the bottom 1*b* is sucked through the introduction opening 19 of the pump frame 7 so as to be introduced into the pump casing 9 through the water passage 21. Then, water is pressurized and accelerated by the blades 37 of the impeller 11, and then moved through the discharge pipe 13. Thus, jet water is jetted from the jet nozzle 45 to the rear portion of the stern 1*a* so that the ship 1 is navigated.

The impeller 11 has the blades 37 spirally joined to the impeller shaft 33. Moreover, the outer peripheries of the blades 37 are positioned adjacent to the inner surface of the pump casing 9. In addition, the leading ends of the introduction portions of the blades 37 are extended to the position adjacent to the suction casing 10. Moreover, the long and twisted guide blades 41 are provided around the portion of the impeller shaft 33 adjacent to the discharge opening 27. Therefore, water introduced into the pump casing 9 through the water passage 21 of the pump frame 7 and the suction casing 10 is pressurized and accelerated by the sequential, and spiral blades 37. Then, water is guided by the twisted guide blades 41 in the axial direction of the impeller shaft 33 so as to be rectified. The impeller 11 having screw blades provided in the forward portion thereof generates strong sucking action by dint of the propelling force of the screw blades. Since the blades 37 of the impeller 11 are continued, centrifugal force is generated in the rear portion of the impeller 11. Therefore, energy added to water in the front portion of the impeller 11 can be converted into energy of the pressure. As a result, excellent sucking performance and propelling performance can be obtained.

The propulsion apparatus 5 is secured to the ship 1 such that the support legs 14 of the mixed flow pump 8 are secured to the frame 12 secured to the bottom 1*b* with bolts. Moreover, the suction opening 26 is connected to the connection opening 17 of the pump frame 7. That is, the water jet propulsion apparatus 5 is secured to the ship 1 at one position in the lower portion of the pump casing 9. Therefore, a process for locating the impeller shaft 33 to coincide with the axis of the drive shaft 49 can easily be performed as compared with the conventional method with which the two ends of the propulsion apparatus are secured. As a result, deviation of the axis of the impeller shaft 33 can reliably be prevented. Therefore, even if vibrations of the engine 3 are transmitted to the impeller shaft 33, the rotating impeller 11 cannot easily be brought into contact with the pump casing 9. As a result, deterioration in the efficiency of the pump occurring by dint of abrasion of the impeller 11 can be prevented.

Since the water jet propulsion apparatus 5 incorporates the mixed flow pump 8, air introduced into the pump casing 9 through the bottom 1*b* can easily be discharged in a case where the ship 1 is raised by dint of waves as compared with the conventional structure incorporating the volute pump casing. Therefore, deterioration in the propelling performance occurring because of generation of cavitation can be prevented.

Since the lowermost portion of the blades 37 of the impeller 11 is lower than the surface of water, the negative pressure in the suction opening 26 of the pump casing 9 and water pressure below the surface of water realize a state in which water reaches the impeller 11 because water can easily be introduced through the introduction opening 19 of the pump frame 7 when navigation is started. As a result, start can easily be performed.

Since the water passage 21 of the pump frame 7 has a short length and also the suction casing 10 has a short length, the actual lift to the impeller 11 can be reduced. Thus, the suction resistance in the suction portion can be reduced. As a result, generation of cavitation when the ship is navigated at high speed can reliably be prevented.

Since the introduction opening 19 of the pump frame 7 is formed into the sector shape having the width which is enlarged in the direction toward the stem, water flows below the bottom 1*b* can widely be picked up during navigation of the ship 1. Since air sucked into the pump casing 9 through the introduction opening 19 can furthermore easily be discharged, deterioration in the propelling performance occurring because of generation of cavitation can furthermore reliably be prevented.

The front end 19*a* of the introduction opening 19 of the pump frame 7 is positioned closer to the stem as compared with the position directly below the front end 17*a* of the connection opening 17. Moreover, the front portion of the water passage 21 of the pump frame 7 is inclined upwards toward the stern 1*a*. Therefore, water below the bottom 1*b* can smoothly be introduced into the pump casing 9 without opposition to the flow of water.

Since the discharge pipe 13 has the shape that the two ends are continued through the curved portion, water pressurized and accelerated by the impeller 11 is moved through the curved discharge pipe 13. Therefore, resistance in the discharge pipe 13 can be prevented.

The connection portion between the mixed flow pump 8 and the pump frame 7 and the connection portion between the mixed flow pump 8 and the discharge pipe 13 are provided with the corresponding flexible joints 55 and 57 each having the elasticity. Therefore, even if the mixed flow pump 8 (the pump casing 9) is located and secured in such a manner that the axes of the impeller shaft 33 and the drive shaft 49 coincide with each other, deviation of the mixed flow pump 8 with respect to the pump frame 7 and the discharge pipe 13 can be absorbed by the flexible joints 55 and 57. Therefore, the axis of the impeller shaft 33 and that of the drive shaft 49 can easily and reliably be made coincide with each other. Thus, deviation of the axis of the impeller shaft 33 can furthermore reliably be prevented. Since the flexible joints 55 and 57 are able to absorb vibrations of the mixed flow pump 8, vibrations which are transmitted to the ship 1 through the pump frame 7 and the discharge pipe 13 can be reduced.

A second embodiment of the present invention will now be described with reference to FIG. 5.

A propulsion apparatus 71 according to this embodiment incorporates two mixed flow pumps 72 and 73 which are in series connected to each other in the horizontal direction. The same elements as those according to the first embodiment are given the same reference numerals and the same elements are omitted from description.

Figure 5:
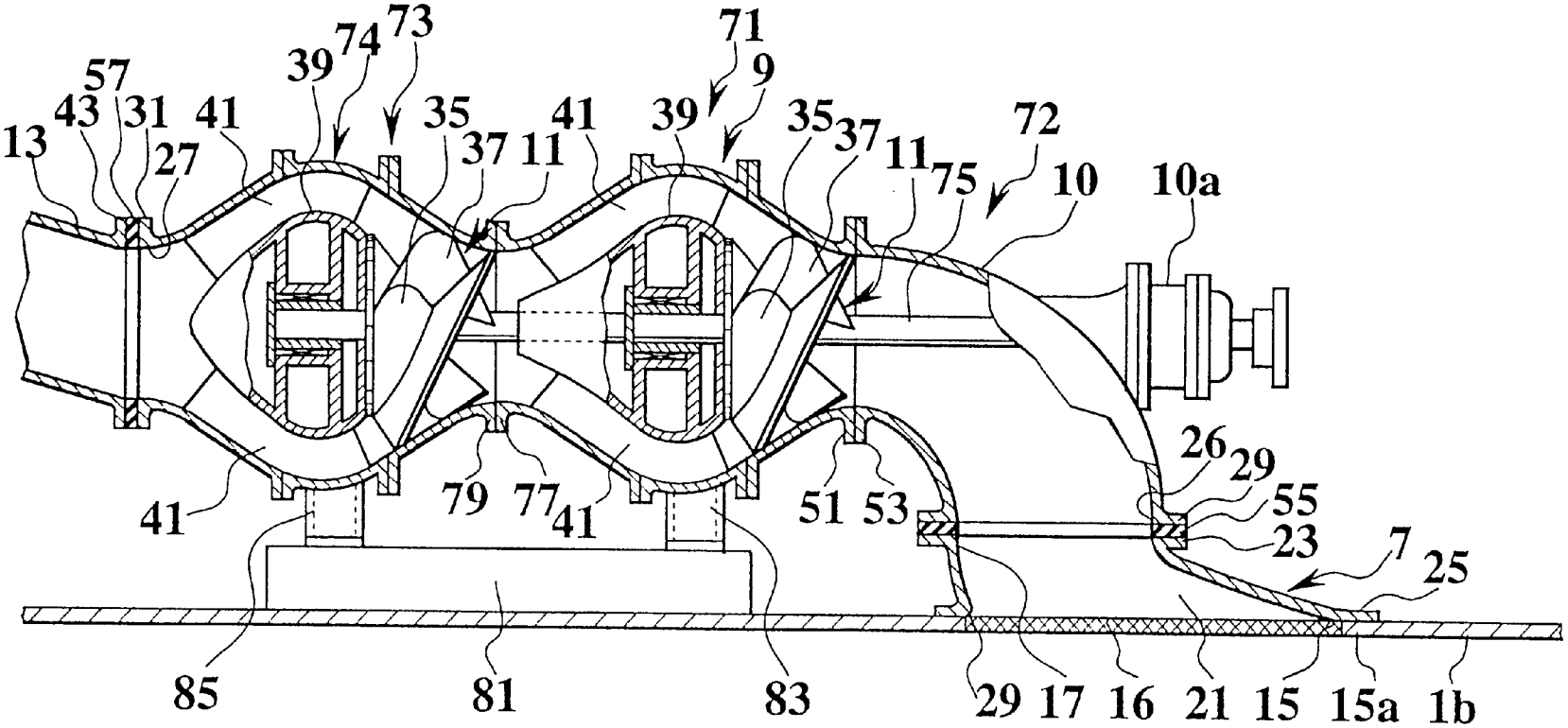
FIG. 5 is a vertical cross sectional view showing a side portion of a water jet propulsion apparatus according to a second embodiment of the present invention.

Specifically, as shown in FIG. 5, the mixed flow pump 8 (see FIG. 2) according to the first embodiment is arranged such that another pump casing (a second pump casing) 74 is disposed between the pump casing (a first pump casing) 9 and the discharge pipe 13. Moreover, an impeller shaft 75 is extended from the first pump casing 9 to the second pump casing 74. Two impellers 11 which are accommodated in the pump casings 9 and 74 are provided for one impeller shaft 75. That is, the mixed flow pump 72 of two mixed flow pumps 72 is composed of the pump casing 9, the suction casing 10 and the impeller 11. The other mixed flow pump 73 is composed of the mixed flow pump 73 and the impeller 11. The two pump casings 9 and 74 are connected to each other by connecting corresponding flanges 77 and 79 to each other in such a manner that communication is permitted. Support legs 83 and 85 are formed to project over the lower portions of the pump casings 9 and 74. The support legs 83 and 85 are secured to a frame 81 provided for the bottom 1*b*.

According to this embodiment, the spiral impellers 11 provided for the two mixed flow pumps 72 and 73 are able to generate propelling force similar to a turbine configuration structure. Therefore, the jetting speed can be raised and thus great propelling force can be obtained. Thus, the ship 1 can be navigated at high speed.

A third embodiment of the present invention will now be described with reference to FIG. 6.

A propulsion apparatus 91 according to this embodiment has a structure that an opening/closing valve 92 is provided for a water passage formed between the introduction opening 19 of the pump frame 7 and the impeller 11. Elements similar to those according to the first embodiment are given the same reference numerals and the similar elements are omitted from description.

Figure 6:
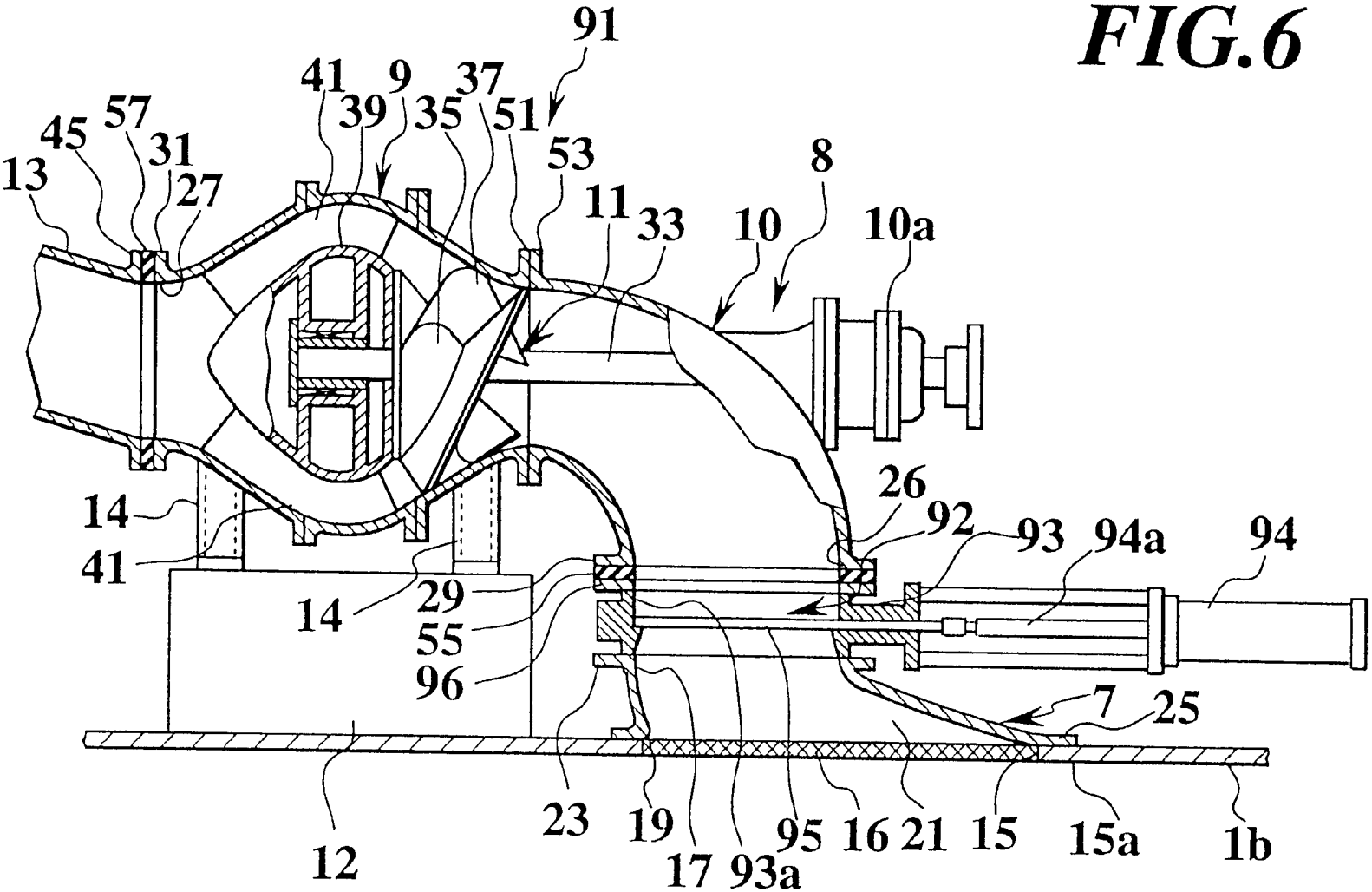
FIG. 6 is a vertical cross sectional view showing a side portion of a water jet propulsion apparatus according to a third embodiment of the present invention.

Specifically, as shown in FIG. 6, the opening/closing valve 92 incorporates a cylindrical valve body 93 having an internal portion 93*a* having a diameter which is substantially the same as the inner diameter of the suction casing 10. Moreover, the opening/closing valve 92 incorporates a cylinder 94 joined to the valve body 93 and a closing plate 95 connected to a drive shaft 94*a* of a cylinder 94. The closing plate 95 follows rotations of the drive shaft 94*a* so as to be inserted into the internal portion 93*a* of the valve body 93. In a state in which the closing plate 95 has completely been inserted, the internal portion 93*a* of the valve body 93 is closed. That is, movement of the closing plate 95 opens/closes the internal portion 93*a* (the opening/closing valve 92) of the valve body 93. The valve body 93 is joined in a state in which the valve body 93 is held between the flange 29 of the suction opening 26 of the suction casing 10 and the flange 23 of the connection opening 17 of the pump frame 7. In the above-mentioned state, the internal portion 93*a* of the valve body 93 is connected to the suction opening 26 and the connection opening 17. The establishment/interruption of the communication between the suction casing 10 and the pump frame 7 through the valve body 93 is performed as follows: when the opening/closing valve 92 is opened, the communication state is realized. When the opening/closing valve 92 is closed, the interrupted state is realized. The flexible joint 55 which is the cushioning member and a flat plate 96 for equalizing an amount of deformation of the flexible joint 55 are disposed between the valve body 93 and the flange 29 of the suction casing 10.

When the opening/closing valve 92 of the above-mentioned structure is closed, the mixed flow pump 91 can be decomposed or removed in a state in which the ship 1 floats on water without a necessity of lifting the ship 1 above the surface of water. Therefore, even if breakdown or the like takes place during navigation, repair and inspection, such as maintenance and part change, can easily be performed.

A fourth embodiment of the present invention will now be described with reference to FIG. 7.

Figure 7:
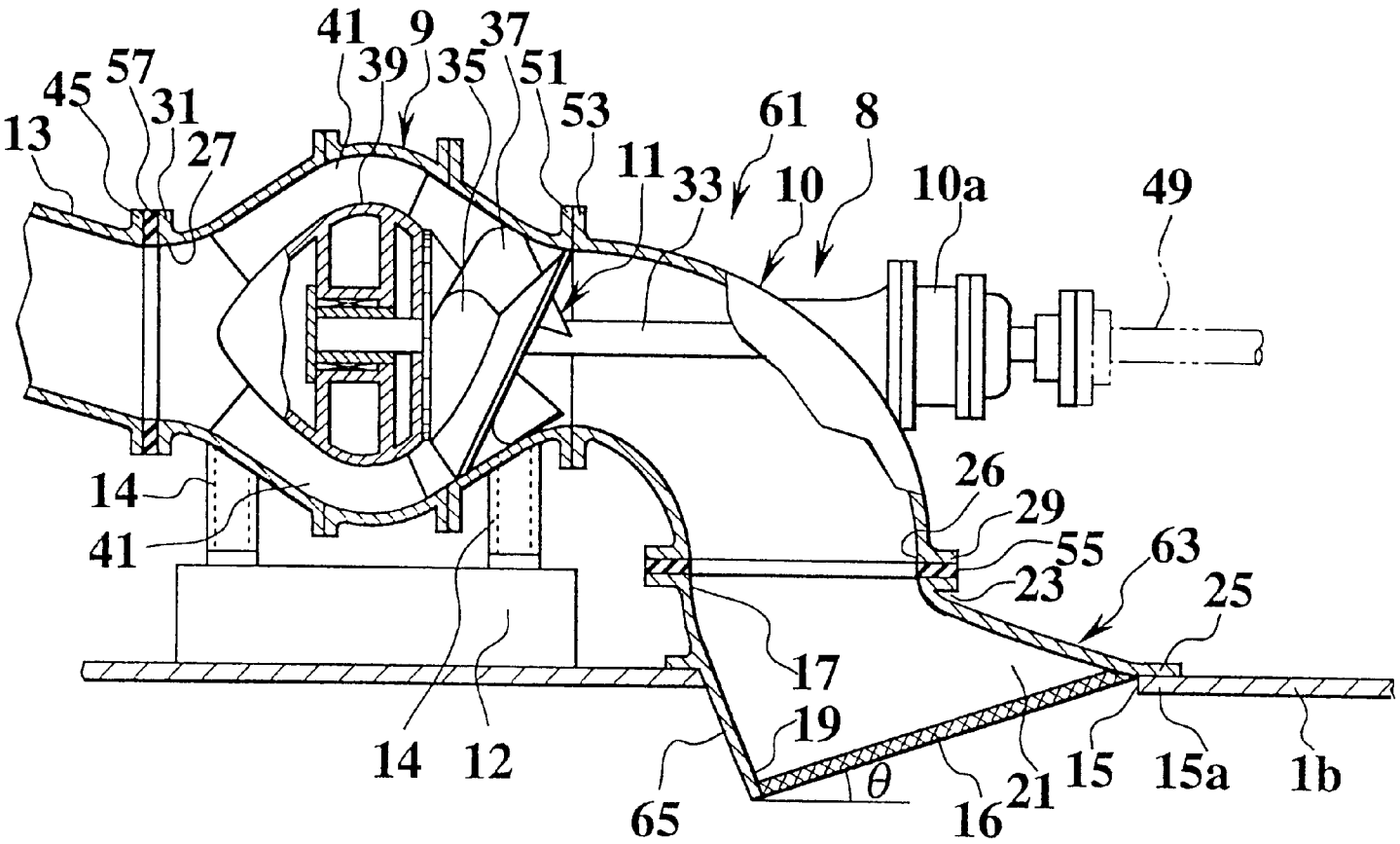
FIG. 7 is a vertical cross sectional view showing a side portion of a water jet propulsion apparatus according to a fourth embodiment of the present invention.

A propulsion apparatus 61 according to this embodiment, as shown in FIG. 7, incorporates a projection 65 into water which is provided for a lower portion of a pump frame 63 adjacent to the stern 1*a*. The projection 65 into water projects downwards over the bottom 1*b* so as to section the introduction opening 19. The introduction opening 19 is upwards inclined to make an angle from the bottom 1*b* to be not less than 20 degrees nor more than 30 degrees ($20° \leqq \theta \leqq 30°$ as shown in FIG. 7). The other structures are similar to those according to the first embodiment. Therefore, the similar elements are given the same reference numerals and the similar elements are omitted from description.

According to this embodiment, water flows can efficiently be introduced into the water passage 21 in addition to the effect obtainable from the first embodiment because the projection 65 downwards projecting into water over the bottom 1*b* receives water flows below the bottom 1*b*. Thus, the propelling force can be enlarged because the amount of introduced water can be enlarged.

INDUSTRIAL APPLICABILITY

As described above, the water jet propulsion apparatus according to the present invention enables air introduced into the pump casing through the bottom of the ship to easily be discharged. Therefore, deterioration in the propelling performance occurring due to generation of cavitation can be prevented.

That is, the water jet propulsion apparatus according to the present invention is able to reduce generation of cavitation which takes place when the ship is navigated at high speed. Therefore,the structure according to the present invention is advantageous as a propulsion source for a variety of ships.

What is claimed is:

1. A water jet propulsion apparatus for a ship partially submerged below a surface of the water, comprising:

a pump frame having an upper opening, a lower opening and a water passage for establishing a communication between the upper and lower openings, the pump frame is adapted to be joined to a bottom of a ship in such a manner that the lower opening is opened into water adjacent to a stern of the ship;

a mixed flow pump having a suction casing with a suction opening, a pump casing with a discharge opening, a rotatable main shaft arranged substantially horizontally in the pump casing, an impeller fixed to the main shaft within the pump casing, and guide blades within the pump casing, the suction opening arranged to be continued from the upper opening, the suction casing arranged to establish a communication between the pump casing and the pump frame, the impeller sucking water below the bottom of the ship through the lower opening so as to pressurize water;

a discharge pipe connected to the discharge opening of the mixed flow pump and arranged to jet out water pressurized by the impeller toward a rear of the stern of the ship, wherein the impeller comprises a hub fixed to the main shaft and blades spirally extending from the hub, each of the blades has an outer end disposed adjacent to an inner surface of the pump casing and a front edge extending from the hub toward the suction casing and inclined relative to the main shaft to increase an introduction area of the impeller substantially, and each of the guide blades has a long and twisted shape and arranged around the main shaft between the discharge opening and the blade.

2. A water jet propulsion apparatus for a ship according to claim 1, wherein lower ends of blades of said impeller are arranged to be disposed below a surface of the water.

3. A water jet propulsion apparatus for a ship according to claim 1, wherein a width of said lower introduction opening of said pump frame is enlarged toward a stem of said ship.

4. A water jet propulsion apparatus for a ship according to claim 1, wherein a front end of said lower introduction opening of said pump frame adjacent to a stem of said ship is located closer to said stem than a front end of said upper connection opening, and a front portion of said water passage of said pump frame adjacent to said stem is inclined upwardly toward said stern of said ship.

5. A water jet propulsion apparatus for a ship according to claim 1, wherein a rear portion of said pump frame adjacent to said stern of said ship includes a projection extending downward over a portion of said bottom of said ship.

6. A water jet propulsion apparatus for a ship according to claim 5, wherein said lower introduction opening of said pump frame is inclined at an angle relative to said bottom of said ship that is not less than 20 degrees nor more than 30 degrees.

7. A water jet propulsion apparatus for a ship according to claim 1, further including a pump support member supporting said mixed flow pump from below and secured to said is adapted to be bottom of said ship.

8. A water jet propulsion apparatus for a ship according to claim 1, further comprising a first elastic cushioning member located between said suction opening of said mixed flow pump and said pump frame and a second elastic cushioning member located between said discharge opening of said mixed flow pump and said discharge pipe.

9. A water jet propulsion apparatus for a ship according to claim 1, further including a plurality of said mixed flow pumps connected in series in a horizontal direction.

10. A water jet propulsion apparatus for a ship according to claim 1, further including an opening/closing valve located between said lower introduction opening of said pump frame and said impeller.

11. A water jet propulsion apparatus for a ship comprising:

a pump frame having an upper connection opening, a lower introduction opening and a water passage establishing communication between said upper connection opening and said lower introduction opening, said pump frame adapted to be secured to a bottom of a ship with said lower introduction opening opened to the bottom of the ship adjacent to a stern of the ship;

a mixed flow pump arranged to be substantially parallel to the bottom of the ship and having a suction opening, a discharge opening and an impeller, said suction opening connected to said upper connection opening, said impeller adapted to pull water from below the bottom of the ship through said lower introduction opening to pressurize the water;

a discharge pipe connected to said discharge opening of said mixed flow pump and arranged to jet out water pressurized by said impeller;

said mixed flow pump includes a pump casing, a suction casing and a main shaft, said pump casing including said discharge opening and accommodating said impeller, said suction casing having said suction opening and arranged to establish communication between said pump casing and said pump frame, and said impeller is located on said main shaft, said main shaft arranged substantially horizontally in said pump casing and rotatable;

blades of said impeller spirally joined to said main shaft, outer ends of said blades disposed adjacent to an inner surface of said pump casing and a front edge extending from the hub toward the suction casing and inclined relative to the main shaft to increase an introduction area of the impeller substantially; and long and twisted guide blades disposed on a bearing case secured to said main shaft more closely adjacent to said discharge portion than said blades of said impeller.

12. A water jet propulsion apparatus for a ship according to claim 11, wherein lower ends of blades of said impeller are arranged to be disposed below a surface of the water.

13. A water jet propulsion apparatus for a ship according to claim 11, wherein a width of said lower introduction opening of said pump frame is enlarged and adapted to be mounted toward a stem of a ship.

14. A water jet propulsion apparatus for a ship according to claim 11, wherein a rear portion of said pump frame includes a projection extending downward; and said lower introduction opening of said pump frame is inclined at an angle that is not less than 20 degrees nor more than 30 degrees.

15. A water jet propulsion apparatus for a ship according to claim 11, further including a pump support member for supporting said mixed flow pump from below and adapted to be secured to the bottom of a ship; and a first elastic cushioning member located between said suction opening of said mixed flow pump and said pump frame and a second elastic cushioning member located between said discharge opening of said mixed flow pump and said discharge pipe.

16. A water jet propulsion apparatus for a ship according to claim 11, wherein said mixed flow pump includes a pump casing, a suction casing and a main shaft, said pump casing including said discharge opening and accommodating said impeller, said suction casing having said suction opening and arranged to establish communication between said pump casing and said pump frame, and said impeller is located on said main shaft, said main shaft arranged substantially horizontally in said pump casing and rotatable;

blades of said impeller spirally joined to said main shaft, outer ends of said blades disposed adjacent to an inner surface of said pump casing and outer leading ends of said blades extending downward toward said suction casing; and long and twisted guide blades disposed on a bearing case secured to said main shaft more closely adjacent to said discharge portion than said blades of said impeller.

17. A water jet propulsion apparatus for a ship according to claim 11, further including a plurality of said mixed flow pumps connected in series in a horizontal direction.

18. A water jet propulsion apparatus for a ship according to claim 11, further including an opening/closing valve located between said lower introduction opening of said pump frame and said impeller.

* * * * *